US008482431B2

(12) United States Patent
Kushi et al.

(10) Patent No.: US 8,482,431 B2
(45) Date of Patent: Jul. 9, 2013

(54) DRIVING SUPPORT APPARATUS

(75) Inventors: Azumi Kushi, Tokyo (JP); Shinji Sawada, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 261 days.

(21) Appl. No.: 12/908,366

(22) Filed: Oct. 20, 2010

(65) Prior Publication Data

US 2011/0095909 A1 Apr. 28, 2011

Related U.S. Application Data

(63) Continuation-in-part of application No. 12/898,077, filed on Oct. 5, 2010, now abandoned.

(30) Foreign Application Priority Data

Oct. 23, 2009 (JP) ..... 2009-244789

(51) Int. Cl.
*G08G 1/09* (2006.01)

(52) U.S. Cl.
USPC ..... 340/905; 340/435; 340/901; 340/903; 340/933; 340/943; 340/425.5; 340/436

(58) Field of Classification Search
USPC ..... 340/435, 901, 903, 905, 933, 943, 340/425.5, 436
See application file for complete search history.

(56) References Cited

U.S. PATENT DOCUMENTS

| | | | | |
|---|---|---|---|---|
| 6,360,171 | B1 | 3/2002 | Miyamoto et al. | |
| 2002/0039065 | A1 * | 4/2002 | Hsiang | 340/435 |
| 2010/0214086 | A1 * | 8/2010 | Yoshizawa et al. | 340/435 |
| 2011/0095907 | A1 * | 4/2011 | Kushi et al. | 340/905 |

FOREIGN PATENT DOCUMENTS

| | | |
|---|---|---|
| JP | 2001-126199 | 5/2001 |
| JP | 2009-31968 | 2/2009 |

* cited by examiner

*Primary Examiner* — Daryl Pope
(74) *Attorney, Agent, or Firm* — Smith, Gambrell & Russell, LLP

(57) ABSTRACT

When an own vehicle waits to turn left or right, a vehicle data processing unit processes information of an oncoming vehicle based on data analyzed by data analyzing units. A support processing unit sets a blind angle rank according to a difficulty degree of recognizing a following vehicle due to the blind angle of a lead vehicle from the relationship in the vehicle body size between the lead and following vehicles based on the oncoming vehicle information, and sets the highest blind angle rank value as an oncoming straight-ahead vehicle rank flag. It also sets an evaluation rank according to a risk degree when the own vehicle turns left or right, based on the oncoming straight-ahead vehicle rank flag and an oncoming vehicle rank flag set according to the size of an oncoming vehicle waiting to turn left or right, and informs the driver of driving support information according to the evaluation rank.

19 Claims, 10 Drawing Sheets

DRIVING SUPPORT APPARATUS

CROSS REFERENCE TO RELATED APPLICATIONS

The present application is a continuation-in-part of application Ser. No. 12/898,077, filed on Oct. 5, 2010. The present application claims priority from Japanese Patent Application No. 2009-244789 filed on Oct. 23, 2009. Each above noted application is incorporated herein by reference in its entirety.

BACKGROUND OF THE INVENTION

1. Field of the Invention

The present invention relates to a driving support apparatus that informs a driver of supporting information relating to whether an oncoming vehicle is present or not when the vehicle turns left or right.

2. Description of Related Art

Japanese Patent Application Laid-Open No. 2001-126199 (hereunder referred to as "Patent Document 1") and Japanese Patent Application Laid-Open No. 2009-31968 (hereunder referred to as "Patent Document 2") disclose a driving support apparatus as a technique for supporting a driving in order to prevent a collision to a vehicle (oncoming vehicle that travels straight ahead), which travels straight ahead on an opposite road, with respect to an own vehicle that is waiting to turn left or right at a traffic intersection. Specifically, when the own vehicle enters a right turn lane or when the vehicle turns on a right-turn signal, the driving support apparatus described in Documents 1 and 2 acquires information of the vehicle, which travels on the opposite road, by road-to-vehicle communication with an infrastructure facility. When the apparatus determines that there is a risk of collision, or when the apparatus determines that the vehicle can turn right with safety, the apparatus informs a driver of the support information indicating the situation.

However, in the technique described in the above-mentioned applications, even when a driver can sufficiently determine whether he/she can turn left or right or not at his/her timing because he/she can well see the opposite road from his/her side, and hence, he/she can well catch a vehicle traveling straight on the opposite road, the driving support apparatus informs the driver of the support information indicating that there is a risk of collision, in case where the oncoming straight-ahead vehicle approaches the traffic intersection. The notification of the support information under such situation might give a redundant impression to the driver, whereby the driver is rather confused, which disturbs driving.

Therefore, an option is that, on an opposite road that can well be seen from a driver's side, the support information relating to the oncoming straight-ahead vehicle is not informed to the driver, in order to reduce a troublesome feeling given to the driver. However, when a vehicle traveling straight (lead straight-ahead vehicle) at the head on the opposite road is a large-sized vehicle, and a vehicle following the large-sized vehicle is an ordinary-sized vehicle or a motorcycle, or when the lead straight-ahead vehicle is an ordinary-sized vehicle, and a vehicle following the ordinary-sized vehicle is a motorcycle, the following vehicle is out of the driver's line of vision. Under this situation, it is preferable that the apparatus informs the driver of the support information relating to the oncoming straight-ahead vehicle.

SUMMARY OF THE INVENTION

The present invention is accomplished in view of the above-mentioned circumstance, and aims to provide a driving support apparatus that sets support information relating to an oncoming vehicle that travels on an opposite road according to the traveling condition of the oncoming vehicle, when the vehicle waits to turn left or right, thereby being capable of not only reducing a troublesome feeling given to a driver but also reliably informing the driver of necessary support information.

An embodiment of the driving support apparatus of the present invention includes an information informing unit that informs a driver of support information; an oncoming vehicle information analyzing unit that analyzes information of an oncoming vehicle acquired from an exterior information transmitting source; an oncoming vehicle data processing unit that checks the position and type of the oncoming vehicle from the oncoming vehicle information analyzed at the oncoming vehicle information analyzing unit; and a support processing unit that sets the support information, which is to be given to an own vehicle waiting to turn across an opposite road on which the oncoming vehicle runs, and outputs the support information to the information informing unit, based on the type and the position of one or more oncoming vehicles checked by the oncoming vehicle data processing unit, wherein the support processing unit includes a blind angle rank setting unit that sets a blind angle rank according to a degree to which a following vehicle enters the blind angle of a lead vehicle, based on the relationship in the type between the lead vehicle and the following vehicle among vehicles traveling straight on the opposite road; and a support information setting unit that sets the support information based on the blind angle rank set by the blind angle rank setting unit.

According to the present invention, the blind angle rank according to the degree to which the following vehicle enters the blind angle of the lead vehicle is set based on the relationship in the type between the lead vehicle and the following vehicle among the vehicles traveling straight on the opposite road, and the support information corresponding to the blind angle rank is given to the driver. Therefore, when the vehicle waits to turn right, for example, the support information corresponding to the traveling condition of the oncoming vehicle is given, whereby not only a troublesome feeling given to the driver can be reduced, but also necessary support information is reliably given to the driver.

DETAILED DESCRIPTION OF THE PREFERRED EMBODIMENT

Figure 1:
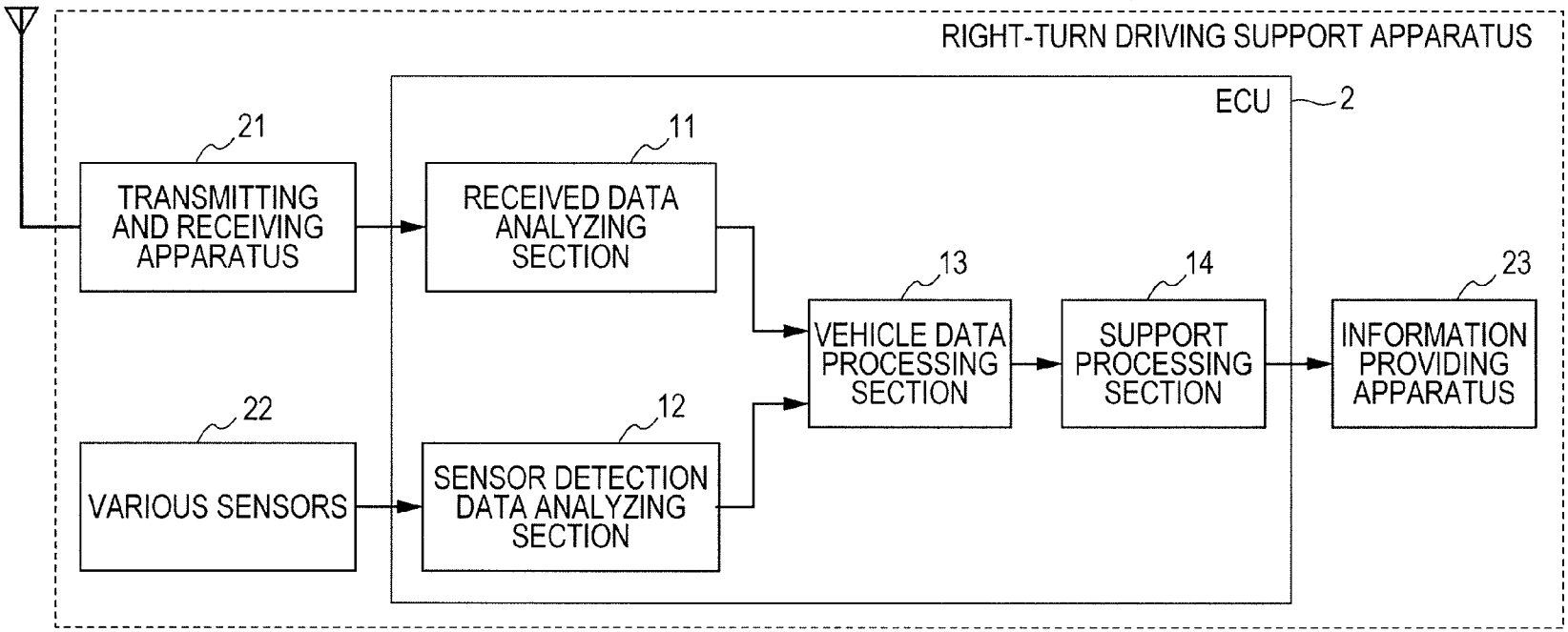
FIG. 1 is a functional block diagram illustrating an overall configuration of a right-turn driving support apparatus embodiment as an example of a driving support apparatus.

An embodiment of the present invention will be explained in detail below with reference to the drawings. The discussion below and referenced illustrations reference a right-turn driving apparatus embodiment, but as seen from the discussion and illustrations of the present application, the driving apparatus is applicable to driving support apparatus for left turns (i.e., a left-turn driving apparatus embodiment).

A right-turn driving support apparatus 1 according to an embodiment of the present embodiment informs a driver of support information for allowing an own vehicle to safely turn right based on the information acquired from the outside of the vehicle or the information acquired from various sensors mounted to the vehicle.

The right-turn driving support apparatus 1 has a control apparatus (ECU) 2. The ECU 2 is composed mainly of a microcomputer. The ECU 2 includes, as a function for realizing a right-turn driving support, a received data analyzing section 11 and a sensor detection data analyzing section 12 serving as the oncoming vehicle information analyzing unit, a vehicle data processing section 13 serving as the oncoming vehicle data processing unit, and a support processing section 14 serving as the support processing unit. The support processing section 14 is connected to an information providing apparatus 23 serving as the information informing unit.

The received data analyzing section 11 analyzes, as data, outside-of-vehicle information that is received by a transmitting and receiving apparatus 21 and that includes oncoming vehicle information. As the exterior information transmitting source, there are the information pieces acquired by road-to-vehicle communication with an infrastructure facility (a beacon transmitting and receiving apparatus in which a beacon includes an optical beacon and radiowave beacon) installed at a position apart from a traffic intersection by a predetermined distance, and information pieces, which is possessed by an opposite vehicle, acquired by inter-vehicle communication with a vehicle traveling in the vicinity of the traffic intersection.

As the information acquired from the infrastructure facility, there are traffic-light information (light color (signal lamp color) of a lighting traffic signal, changeover remaining-time information of the lighting signal lamp color, and changeover cycle information), distance information from the infrastructure facility to a stop line formed on the traffic intersection, road-shape information (number of lanes of the opposite road, etc.) and information about a vehicle traveling on the opposite road (oncoming vehicle information). The oncoming vehicle information also includes information relating to the oncoming vehicle, such as vehicle type for every oncoming vehicle, traveling speed and inter-vehicular distance between the oncoming vehicle and a lead vehicle, and course information as to whether the oncoming vehicle travels on a lane for through traffic or on a right turn lane (whether the oncoming vehicle is an oncoming straight-ahead vehicle or an oncoming right-turning vehicle). The oncoming vehicle information can be acquired by inter-vehicle communication with the oncoming vehicle.

The sensor detection data analyzing section 12 analyzes, as data, the information detected by various sensors 22 mounted to the own vehicle. Examples of the various sensors 22 mounted to the vehicle include an autonomous sensor and a sensor detecting the driving condition of the vehicle. The autonomous sensor detects environmental information in the traveling direction of the vehicle. Examples of the autonomous sensor include a laser radar, millimeter wave radar, infrared sensor, and camera. The sensor detection analyzing section 12 analyzes whether a lead vehicle is present or not and the information of a vehicle traveling on the opposite road based on the information detected by the autonomous sensor. When a camera is mounted as the autonomous sensor, signal color information or lighting information of a right-turn arrow lamp can be acquired by the camera.

The vehicle data processing section 13 processes, as data, the information about a lead vehicle that is turning right (right-turning lead vehicle) and the information of an oncoming vehicle, based on the respective data analyzed by the data analyzing sections 11 and 12.

The support processing section 14 determines whether the right-turn support information is to be given to the driver of the own vehicle that waits to turn right, based on the road-shape information of the opposite road, the oncoming vehicle information, and the information about the right-turning lead vehicle processed by the vehicle data processing section 13. When it determines that the right-turn support information is required to be given to the driver, it gives the right-turn support information to the driver through the information providing apparatus 23.

The information providing apparatus 23 is an image/voice display apparatus utilizing a monitor or speaker of a car navigation system, an image display apparatus such as a liquid crystal monitor, a speech display apparatus such as a speaker system, a light-emitting display apparatus that displays textual information by lighting and blinking many arranged light-emitting devices, such as LED, or a buzzer or a warning lamp. The information providing apparatus 23 informs the driver of the right-turn support information by one or more of visual or auditory informing methods such as image information, speech information, or textual information.

Figure 2:
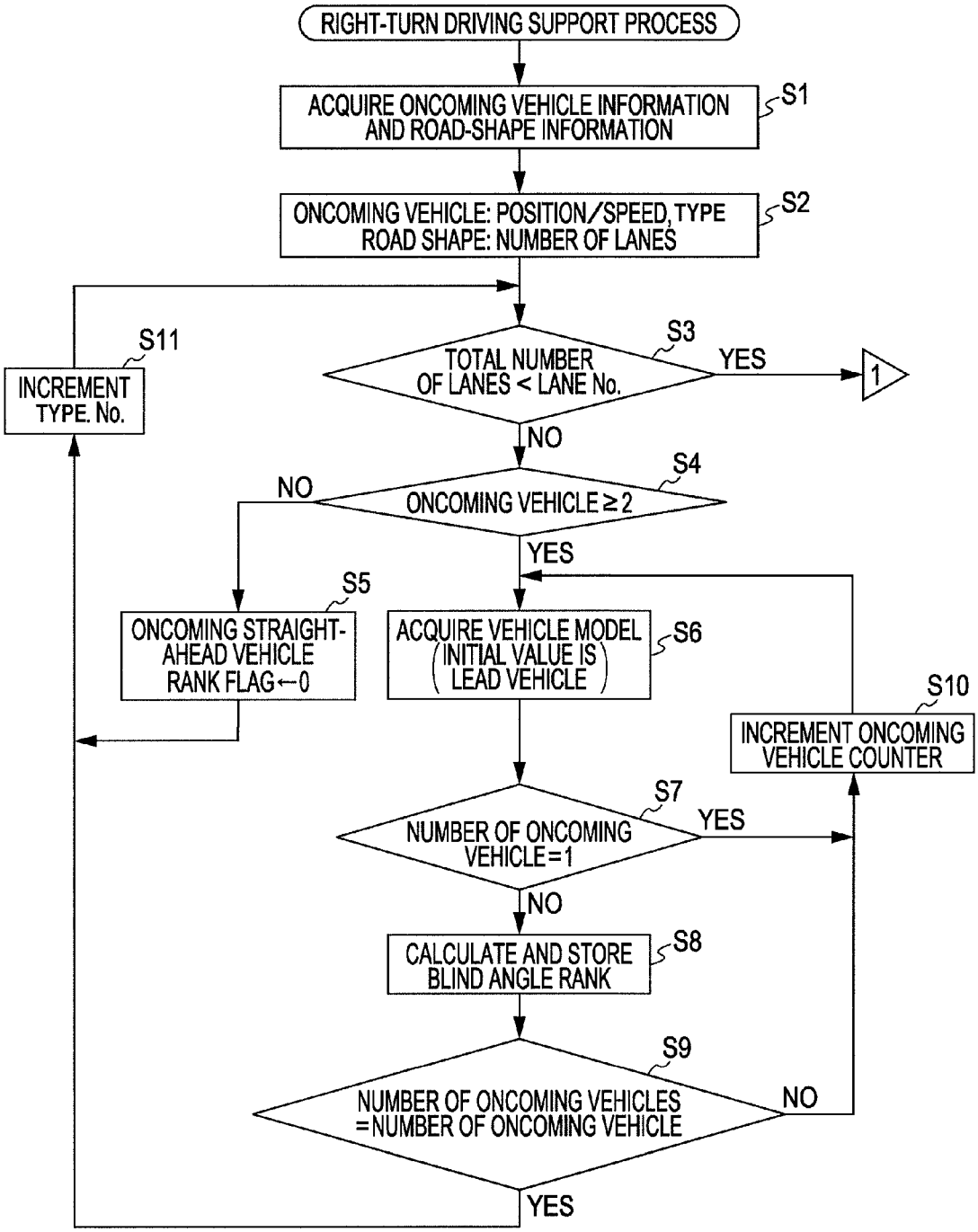
FIG. 2 is a flowchart (1) illustrating a right-turn driving support process routine.
Figure 3:
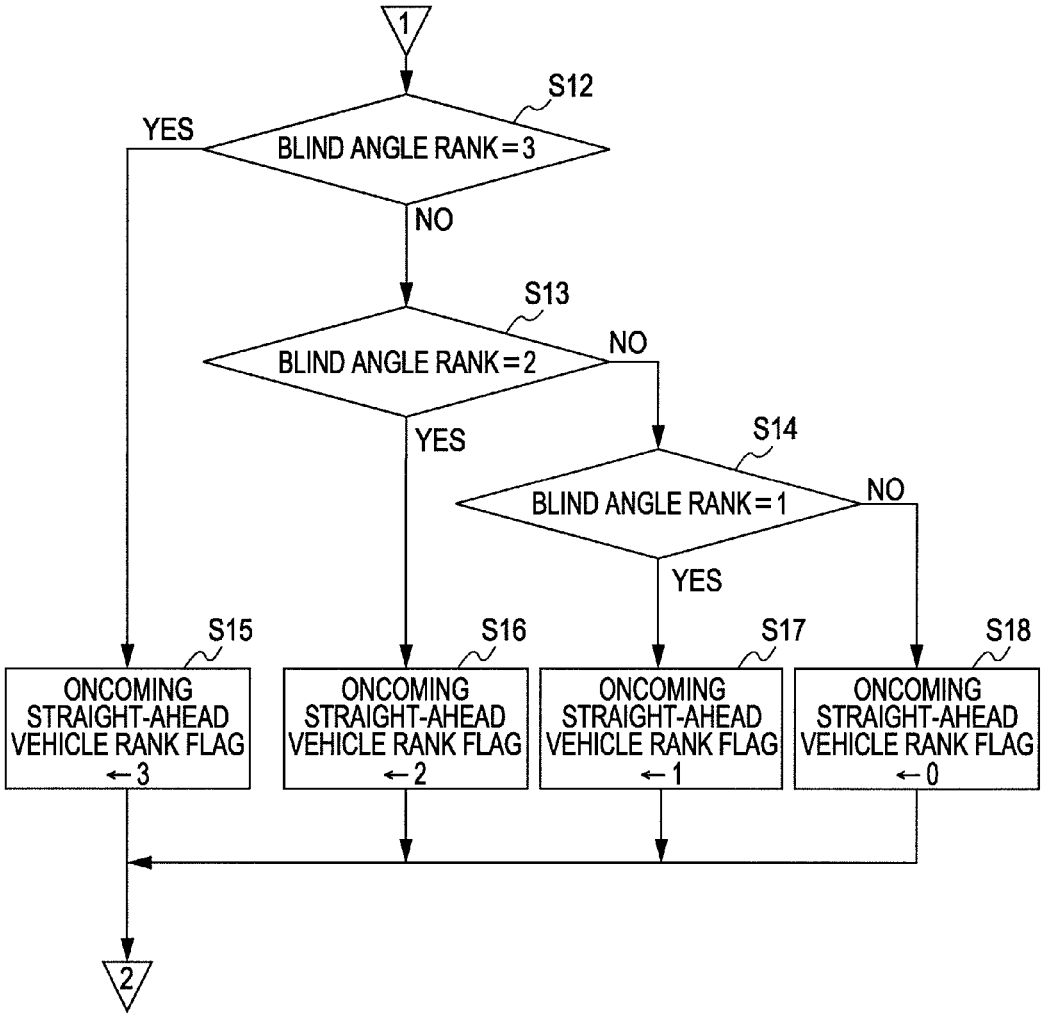
FIG. 3 is a flowchart (2) illustrating a right-turn driving support process routine.
Figure 4:
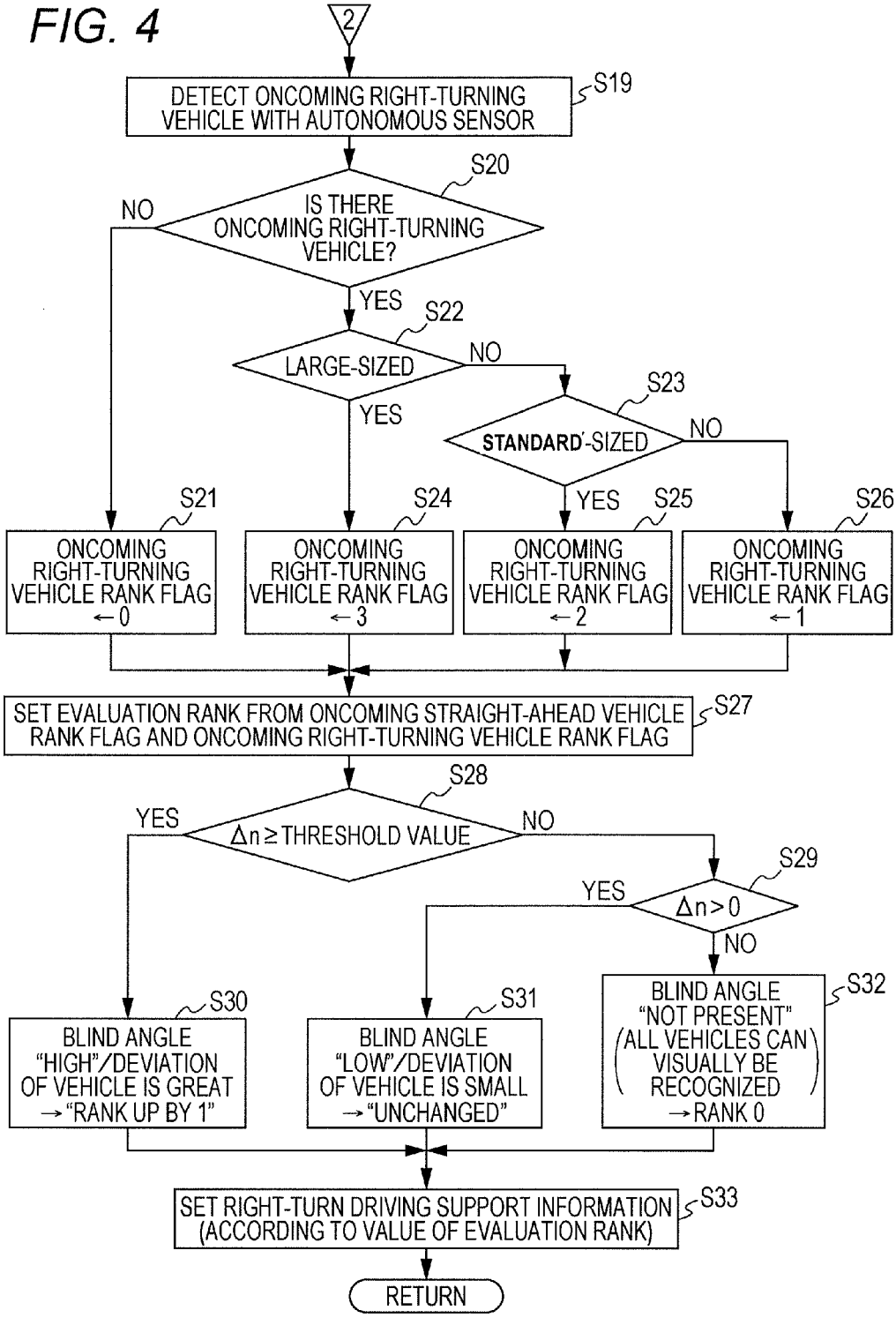
FIG. 4 is a flowchart (3) illustrating a right-turn driving support process routine.

The right-turn driving support process upon executed by the support processing section 14 is specifically performed based on a right-turn driving support process routine illustrated in FIGS. 2 and 3.

In this routine, the oncoming straight-ahead vehicle information and the road-shape information (the total number of the lanes) of the opposite road are acquired in step S1. In step S2, the number of the oncoming straight-ahead vehicles, and the position, speed, and type of each of the oncoming straight-ahead vehicles are read based on the acquired oncoming straight-ahead vehicle information, and the total number (total number of the lanes for through traffic) of the lanes for through traffic (opposite lane for through traffic) in the opposite road is read from the road-shape information.

Then, in step S3, the support processing section 14 compares a lane number and the total number of the lanes for through traffic. The initial value of the lane number is 1. The lane number is the number allocated to each opposite lane for through traffic. In the present embodiment, the lane number is allocated from a road shoulder to a center. Therefore, when the total number of the lanes for through traffic is two, the lane number is allocated as 1 and 2 from the road shoulder to the center. It is to be noted that the lane number may be allocated as 1 and 2 from the center to the road shoulder.

When the support processing section 14 determines that the oncoming straight-ahead vehicle information for each of the opposite lanes for through traffic has not yet been confirmed (total number of lanes≧lane number), it proceeds to step S4. When the support processing section 14 determines that the confirmation of the oncoming straight-ahead vehicle information for each of the opposite lanes for through traffic has been all completed (total number of lanes<lane number), it branches to step S12. As described below, the information of the oncoming straight-ahead vehicle is checked for each of the opposite lanes for through traffic in this embodiment. Therefore, the processes after step S4 are repeatedly executed until the lane number exceeds the total number of the lanes for through traffic.

When proceeding to step S4, the support processing section 14 checks whether the number of the oncoming vehicles (oncoming-vehicle number) traveling on the opposite lane for through traffic having a currently set lane number (the initial value is 1) is 2 or larger or not. A range where the oncoming straight-ahead vehicle information is acquired is set beforehand for every infrastructure facility. When the infrastructure facility transmits the oncoming straight-ahead vehicle information in a wide range, the search range may be narrowed in the support processing section 14. In this case, the search range is set according to the total number of the lanes for through traffic such that the search range is set to be wider as the total number of the lanes for through traffic increases. For example, when the total number of the lanes for through traffic is 1 (a so-called one lane at one side), the search range is set to be about 80 m from the own vehicle. Every time the number of lanes increases by 1, the search range may be set to be increased by 50 m.

When the number of the oncoming straight-ahead vehicles traveling on the opposite lane for through traffic having the currently set lane number is 1, the support processing section 14 proceeds to step S5 where it clears an oncoming straight-ahead vehicle rank flag (oncoming straight-ahead vehicle rank flag←0), and then, jumps to step S11. The oncoming straight-ahead vehicle rank flag will be described below.

In step S11, the support processing section 14 increments the lane number (lane number (new)←lane number (old)+1), and then, returns to step S3. When the number of the oncoming vehicle traveling on the opposite lane for through traffic is 1, which means there is no following vehicle, the vehicle can turn right after the oncoming vehicle passes. Therefore, the degree of risk upon the right turn is low.

On the other hand, when the support processing section 14 determines that the number of the oncoming straight-ahead vehicles traveling on the opposite lane for through traffic having the currently set lane number is 2 or larger, the support processing section 14 proceeds to step S6, and in step S6 and following steps, it checks the oncoming straight-ahead vehicle information of each of the oncoming vehicles traveling on the opposite lane for through traffic corresponding to the lane number.

In step S6, the support processing section 14 acquires the vehicle type from the oncoming straight-ahead vehicle information of the oncoming vehicle corresponding to an oncoming vehicle number. In the present embodiment, the vehicle type is classified into three types according to a size of a vehicle body, which are a large-sized vehicle, a standard-sized vehicle, and a motorcycle.

The oncoming vehicle number is incremented in later-described step S10, and the initial value is set to be 1. In the present embodiment, the oncoming vehicle number is allocated successively from a lead vehicle to following vehicles.

Then, the support processing section 14 proceeds to step S7 where it checks whether the oncoming vehicle number is 1 or not, i.e., whether the oncoming straight-ahead vehicle is the lead vehicle or not. If the oncoming vehicle is the lead vehicle (the oncoming vehicle number=1), it proceeds to step S10. When the oncoming vehicle number is 2 or larger, the support processing section 14 proceeds to step S8. Accordingly, when the oncoming vehicle is the lead vehicle having the oncoming vehicle number of 1, the support processing section 14 increments the oncoming vehicle number by an oncoming vehicle counter (oncoming vehicle number (new)←oncoming vehicle number (old)+1) in step S10, and then, returns to step S6. In step S6, the support processing section 14 acquires the type of the oncoming straight-ahead vehicle having the oncoming vehicle number of 2, i.e., the oncoming straight-ahead vehicle following the lead vehicle.

When proceeding to step S8 from step S7, the support processing section 14 refers to Table 1 below so as to calculate a blind angle rank based on the vehicle type of the oncoming straight-ahead vehicle (oncoming vehicle number (new)) that is acquired this time and the vehicle type of the oncoming straight-ahead vehicle (oncoming vehicle number (old)) that is acquired previously. The process in this step corresponds to the blind angle rank setting unit of the present invention.

TABLE 1

| | | Following vehicle | | |
|---|---|---|---|---|
| | | Large-sized vehicle | Standard-sized vehicle | Motorcycle |
| Opposite lane | Large-sized vehicle | 2 | 3 | 3 |
| Lead vehicle | Standard-sized vehicle | 1 | 2 | 3 |
| | Motorcycle | 1 | 1 | 2 |

TABLE 2

| Blind angle rank | Degree of risk |
|---|---|
| 1 | Low |
| 2 | Middle |
| 3 | High |

Figure 7:
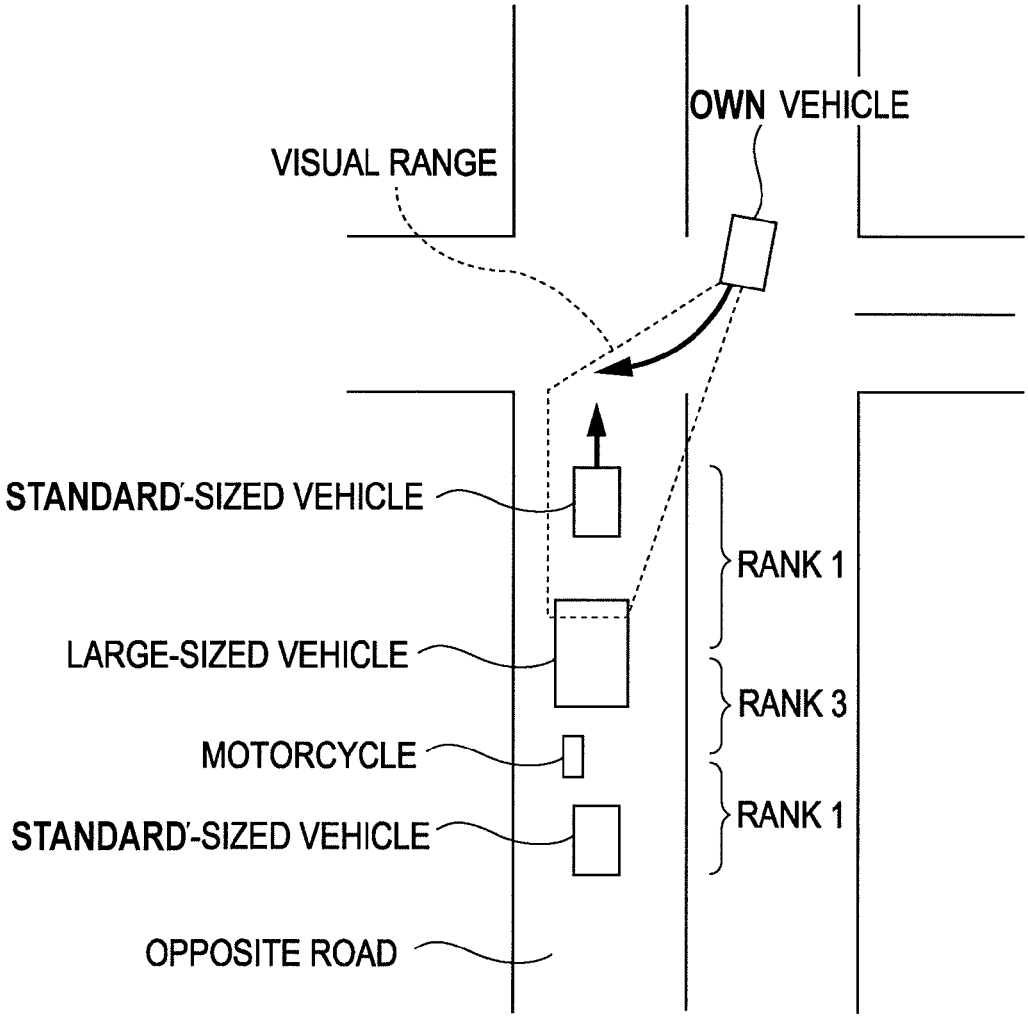
FIG. 7 is an explanatory view illustrating a blind angle rank of an oncoming straight-ahead vehicle upon a right turn.
Figure 8A:
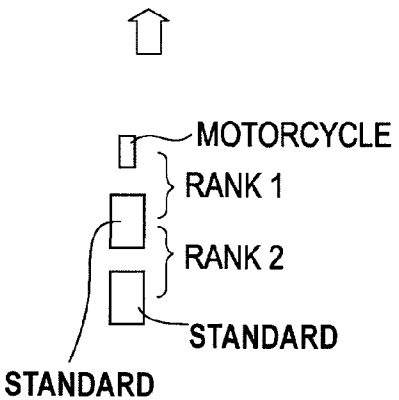
FIG. 8 is an explanatory view illustrating a blind angle rank for every arrangement of an oncoming straight-ahead vehicle that travels in a line.
Figure 8B:
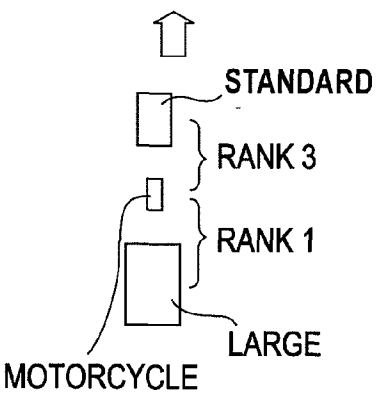
Figure 8C:
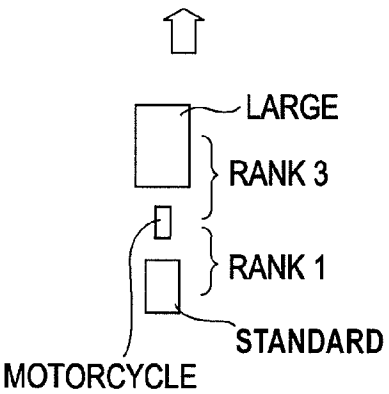
Figure 8D:
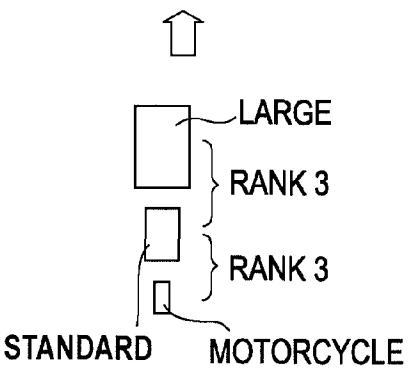

As shown in Table 2, the blind angle rank is classified into three levels according to the degree to which the following vehicle enters the blind angle of the lead vehicle from the relationship in the vehicle type (size of the vehicle body) between the lead vehicle and the following vehicle. The blind angle rank is set to be greater as the degree (degree of risk) to which the following vehicle enters the blind angle of the lead vehicle is greater. Accordingly, in the present embodiment, the blind angle rank 1 is set to be "low" in the degree of risk, the blind angle rank 2 is set to be "middle" in the degree of risk, and the blind angle rank 3 is set to be "high" in the degree of risk. Specifically, as illustrated in FIG. 7, in case where the number of the oncoming straight-ahead vehicles traveling on the opposite road is 4, and a visual range of the driver is up to the second vehicle from the head traveling on the opposite road, when the vehicle waits to turn right, the driver cannot recognize the third and the fourth vehicles from the head. However, after the lead vehicle passes the traffic intersection, the second vehicle illustrated in the figure becomes the lead vehicle. Therefore, the following vehicle becomes the lead vehicle after all when it approaches the traffic intersection. Accordingly, the degree of risk may be set between two successive vehicles.

FIG. 7 illustrates the state in which a standard-sized vehicle (the oncoming vehicle number is 1), a large-sized vehicle (the oncoming vehicle number is 2), a motorcycle (the oncoming vehicle number is 3), and a standard-sized vehicle (the oncoming vehicle number is 4) travel in a line from the head in this order. The relationship between the standard-sized vehicle (the oncoming vehicle number is 1) and the large-sized vehicle (the oncoming vehicle number is 2) is as follows. Specifically, since the vehicle body of the large-sized vehicle is larger than that of the standard-sized vehicle, the large-sized vehicle following the standard-sized vehicle can easily be recognized from the driver of the own vehicle waiting to turn right. Accordingly, the blind angle rank is "1." The relationship between the large-sized vehicle (the oncoming vehicle number is 2) and the motorcycle (the oncoming vehicle number is 3) is as follows. Specifically, since the vehicle body of the motorcycle is smaller than that of the large-sized vehicle, the driver of the own vehicle waiting to turn right is difficult to recognize the motorcycle following the large-sized vehicle. Accordingly, the blind angle rank is "3". Similarly, the relationship between the motorcycle (the oncoming vehicle number is 3) and the standard-sized vehicle (the oncoming vehicle number is 4) is as follows. Specifically, since the vehicle body of the standard-sized vehicle is larger than that of the motorcycle, the standard-sized vehicle following the motorcycle can easily be recognized from the driver of the vehicle waiting to turn right. Accordingly, the blind angle rank is "1".

Similarly, FIGS. 8A to 8D illustrates the blind angle ranks set between vehicles traveling in a line. As illustrated in FIGS. 8A to 8D, the blind angle ranks are set within the range of 1 to 3 from the relationship between a lead vehicle and a following vehicle. Specifically, when the lead vehicle is a motorcycle, and the following vehicle is a standard-sized vehicle or a large-sized vehicle, the portion of the following vehicle that is out of the range of the blind angle of the lead vehicle can easily be recognized from the own vehicle waiting to turn right. Therefore, the blind angle rank is set to be "1." When the vehicle type is the same between the lead vehicle and the following vehicle, the following vehicle is in and out of the blind angle of the lead vehicle. This means that the following vehicle cannot always be recognized at all. Therefore, the blind angle rank is set to be "2." When the lead vehicle is an standard-sized vehicle or a large-sized vehicle, and the following vehicle is a motorcycle, the motorcycle is in the blind angle of the lead vehicle. Therefore, the blind angle rank is set to be "3." Similarly, the blind angle rank is set to be "3" when the lead vehicle is a large-sized vehicle and the following vehicle is an standard-sized vehicle.

Thereafter, the support processing section 14 proceeds to step S9 to compare the number of the oncoming vehicles and the oncoming vehicle number. When the oncoming vehicle number does not reach the number of the oncoming vehicles (number of oncoming vehicles>oncoming vehicle number), the support processing section 14 proceeds to step S10 where it increments the oncoming vehicle number (oncoming vehicle number (new)←oncoming vehicle number (old)+1), and then, returns to step S6. When the oncoming vehicle number reaches the number of the oncoming vehicles (number of oncoming vehicles=oncoming vehicle number), i.e., when the support processing section 14 determines that the vehicle type of all oncoming vehicles traveling within the search range on the opposite lane corresponding to the lane number allocated to the opposite road are acquired, the support processing section 14 proceeds to step S11 to increment the lane number, and then, returns to step S3. Then, in step S3, the support processing section 14 determines that the vehicle types of all oncoming straight-ahead vehicles traveling on the opposite lane for through traffic are checked, since the total number of lanes is greater than the lane number (total number of lanes<lane number). Then, it branches to step S12.

When branching to step S12, the support processing section 14 checks the highest blind angle rank in steps S12 to S14. When the highest blind angle rank is 3, the support processing section 14 proceeds to step S15 where it sets the oncoming straight-ahead vehicle rank flag to "3" (the oncoming straight-ahead vehicle rank flag←3), and then, proceeds to step S19. When the highest blind angle rank is 2, the support processing section 14 proceeds to step S16 where it sets the oncoming straight-ahead vehicle rank flag to "2" (the oncoming straight-ahead vehicle rank flag←2), and then, proceeds to step S19.

When the highest blind angle rank is 1, the support processing section 14 proceeds to step S17 where it sets the oncoming straight-ahead vehicle rank flag to "1" (the oncoming straight-ahead vehicle rank flag←1), and then, proceeds to step S19. When an oncoming straight-ahead vehicle does not travel, the support processing section 14 proceeds to step S18 where it sets the oncoming straight-ahead vehicle rank flag to "0" (the oncoming straight-ahead vehicle rank flag←0), and then, proceeds to step S19. The processes in steps S15 to S18 correspond to an oncoming straight-ahead vehicle rank flag setting unit in the present invention.

As described above, in the present embodiment, the blind angle ranks are set for all oncoming straight-ahead vehicles acquired from the infrastructure facility from the relationship in the size of the vehicle body between a lead vehicle and following vehicle, among the plural oncoming straight-ahead vehicles traveling on the same opposite lane. The oncoming straight-ahead vehicle rank flag is set based on the highest blind angle rank of all the blind angle ranks, whereby the driver of the own vehicle waiting to turn right can easily recognize that a standard-sized vehicle or a motorcycle travels after a large-sized vehicle when the driver finds the large-sized vehicle among the vehicles traveling on the opposite lane. Since the oncoming straight-ahead vehicle rank flag is based on the highest blind angle rank, later-described support information is not given for all relationships between the lead vehicle and the following vehicle, whereby a troublesome feeling given to the driver can be reduced.

Figure 9:
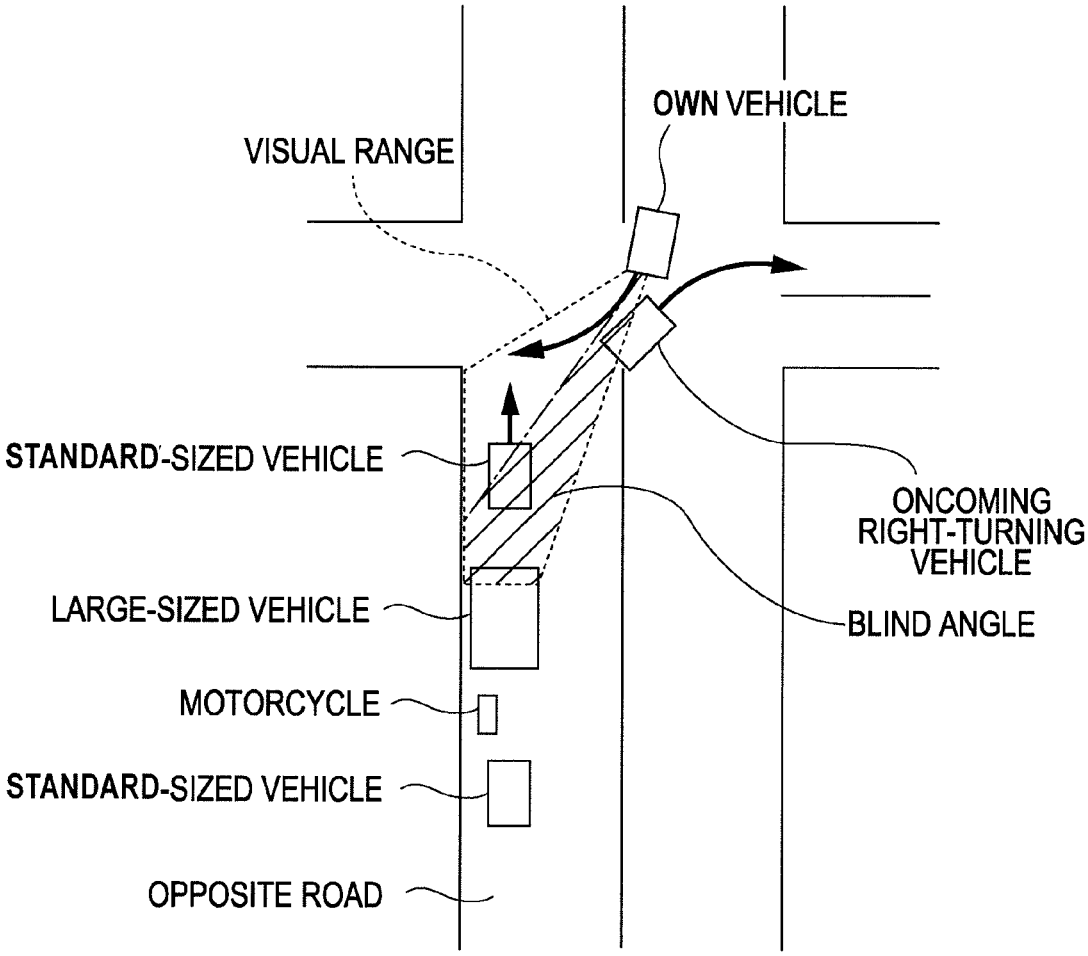
FIG. 9 is an explanatory view illustrating a degree of risk of the oncoming straight-ahead vehicle upon the right turn when there is an oncoming right-turning vehicle.

When the support processing section 14 proceeds to step S19 from any one of steps S15 to S18, it checks whether or not an oncoming vehicle (oncoming right-turning vehicle) is present on a right turn lane of the opposite road in step S19 and the following steps. Specifically, as illustrated in FIG. 9, when the visual range of the driver driving the own vehicle waiting to turn right is up to the second vehicle from the lead vehicle traveling on the opposite lane, and an oncoming right-turning vehicle is present in the visual range, a blind angle is formed because of the presence of the oncoming right-turning vehicle. When the oncoming right-turning vehicle is a large-sized vehicle, even the lead vehicle cannot visually be recognized easily. Therefore, in step S19 and the following steps, the vehicle type of the oncoming right-turning vehicle is identified, and the above-mentioned blind angle rank is weighted according to the vehicle type. The lead vehicle mostly hinders the vision of the driver upon the right turn. Therefore, the oncoming right-turning vehicle in the present embodiment indicates the oncoming right-turning lead vehicle.

Figure 10A:
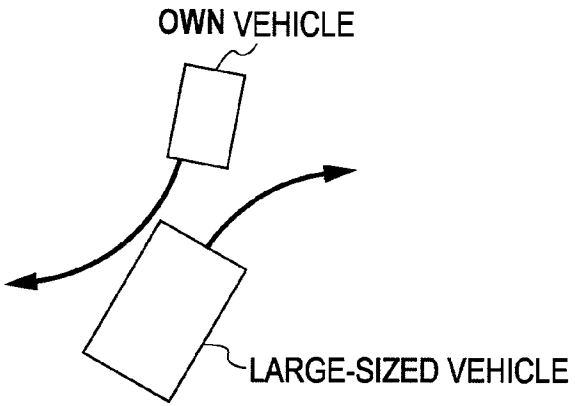
FIG. 10 is an explanatory view illustrating a degree of risk of an oncoming right-turning vehicle for every type of the vehicle.
Figure 10B:
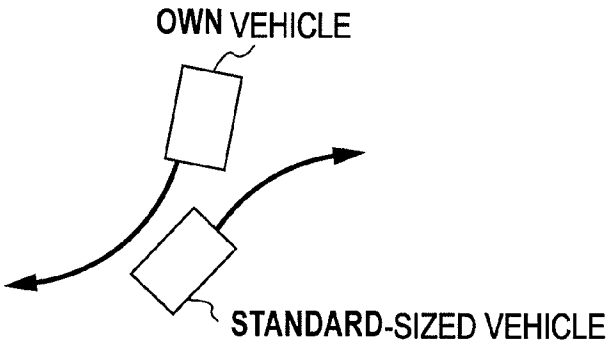

As illustrated in FIG. 10, the range of the blind angle is different depending upon the vehicle type. When the oncoming right-turning vehicle is a large-sized vehicle as illustrated in FIG. 10A, the range of the blind angle is wide because the vehicle body is large. On the other hand, when the oncoming right-turning vehicle is a standard-sized vehicle as illustrated in FIG. 10B, the hindrance of the vision is small, compared to the large-sized vehicle. Therefore, the blind angle is narrow.

Figure 10C:
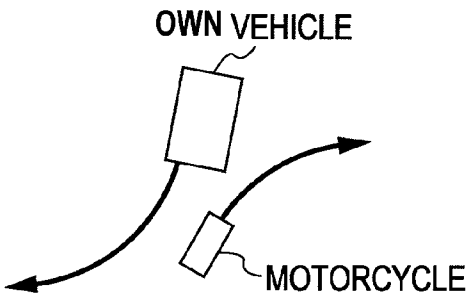

When the oncoming right-turning vehicle is a motorcycle as illustrated in FIG. 10C, the vision is hardly hindered, so that the oncoming straight-ahead vehicle can be recognized. A later-described oncoming right-turning vehicle rank flag is set according to the range of the blind angle formed by the oncoming right-turning vehicle.

Firstly, in step S19, the support processing section 14 checks whether an oncoming right-turning vehicle is present or not based on the environmental information in the traveling direction of the own vehicle detected by the autonomous sensor mounted to the vehicle. The support processing section 14 checks in step S20 whether the oncoming right-turning vehicle is present or not, and when the oncoming right-turning vehicle is not present, it proceeds to step S21 to set the oncoming right-turning vehicle rank flag to 0 (oncoming right-turning vehicle rank flag←0), and jumps to step S27. When there is an oncoming right-turning vehicle, the support processing section 14 proceeds to step S22 to identify the vehicle type of the oncoming right-turning vehicle in steps S22 and S23. The presence of the oncoming right-turning vehicle may be determined based on the information obtained by road-to-vehicle communication with an infrastructure facility installed in the vicinity of a traffic signal or the information obtained by the inter-vehicle communication with a vehicle passing through the traffic intersection. The processes in steps S20, S21, S22 and S23 correspond to an oncoming right-turning vehicle determining unit in the present invention.

The oncoming right-turning vehicle rank flag is set by referring to Table 3 described below.

TABLE 3

| | | Rank flag |
|---|---|---|
| Oncoming right-turning vehicle | Large-sized vehicle | 3 |
| | Standard-sized vehicle | 2 |
| | Motorcycle | 1 |
| | No vehicle | 0 |

As described above, the vehicle type is classified into three types, which are a large-sized vehicle, an standard-sized vehicle, and a motorcycle in the present embodiment. The oncoming right-turning vehicle rank flag is set according to the blind angle formed by the oncoming right-turning vehicle. Specifically, as the blind angle increases (the degree to which the oncoming straight-ahead vehicle is difficult to be recognized from the driver increases), and the degree to which the oncoming straight-ahead vehicle is hidden because of the blind angle increases, a higher rank flag value is set. Specifically, in the present embodiment, a rank flag of 3 is set for a large-sized vehicle, a rank flag of 2 is set for a standard-sized vehicle, a rank flag of 1 is set for a motorcycle, and a rank flag of 0 is set for the case in which the oncoming right-turning vehicle is not present. Table 4 illustrates the relationship between the oncoming right-turning vehicle rank flag and the degree of risk.

TABLE 4

| Rank flag | Degree of risk |
|---|---|
| 0 | Zero |
| 1 | Low |
| 2 | Middle |
| 3 | High |

When the support processing section 14 determines that the oncoming right-turning vehicle is a large-sized vehicle in step S22, it proceeds to step S24 to set the oncoming right-turning vehicle rank flag to 3 (oncoming right-turning vehicle rank flag←3), and then, proceeds to step S27. In the case of a standard-sized vehicle, the support processing section 14 proceeds to step S25 to set the oncoming right-turning vehicle rank flag to 2 (oncoming right-turning vehicle rank flag←2), and then, proceeds to step S27. In the case of a motorcycle, the support processing section 14 proceeds to step S26 to set the oncoming right-turning vehicle rank flag to 1 (oncoming right-turning vehicle rank flag←1), and then, proceeds to step S27. The processes in steps S21 and S24 to S26 correspond to an oncoming right-turning vehicle rank flag setting unit in the present invention.

When the support processing section 14 proceeds to step S27 from any one of steps S21 and steps S24 to S26, it sets a comprehensive evaluation rank to the degree of risk upon the right turn by referring to Table 5 based on the value of the oncoming straight-ahead vehicle rank flag set in any one of steps S15 to S18 and the value of the oncoming right-turning vehicle rank flag set in any one of steps S21 and S24 to S26.

TABLE 5

| | | Oncoming right-turning vehicle rank flag | | | | |
|---|---|---|---|---|---|---|
| | | 0 (no vehicle) | 1 (motor-cycle) | 2 (standard) | 3 (large) | |
| Oncoming straight-ahead vehicle rank flag | 0 | 0 | 0 | 0 | 0 | Low |
| | 1 | 1 | 1 | 2 | 3 | ↓ |
| | 2 | 2 | 2 | 4 | 6 | ↓ |
| | 3 | 3 | 3 | 6 | 9 | High |
| | | Low → | | | | High |

As indicated in the table, when both the oncoming straight-ahead vehicle rank flag and the oncoming right-turning vehicle rank flag are 0, i.e., when there is no oncoming vehicle, entering the traffic intersection, on the opposite road, the degree of risk is the lowest. Therefore, the evaluation rank is set to be 0. When both the oncoming straight-ahead vehicle rank flag and the oncoming right-turning vehicle rank flag are 3, i.e., when it is the most difficult to turn the vehicle to the right, the evaluation rank is set to be 9 that indicates the highest degree of risk. The comprehensive evaluation rank is set within 0, which indicates the lowest degree of risk, to 9, which indicates the highest degree of risk, from the combinations of the values of the oncoming straight-ahead vehicle rank flag and the values of the oncoming right-turning vehicle rank flag.

Thereafter, the support processing section 14 proceeds to step S28, and executes a weighting process to the evaluation rank in steps S28 to S32.

Firstly, in step S28, the support processing section 14 calculates a difference Δn between the number of the oncoming straight-ahead vehicles acquired based on the oncoming straight-ahead vehicle information provided from the infrastructure facility, which is installed at a side of the opposite road apart from the traffic intersection by a predetermined distance, and the number of the oncoming straight-ahead vehicles acquired by the autonomous sensor mounted to the vehicle. The support processing section 14 compares the difference Δn and a threshold value. In the case of Δn<threshold value, the support processing section 14 proceeds to step S29, while in the case of Δn≧threshold value, it proceeds to step S30. The threshold value is set as a value obtained by adding a predetermined value (e.g., 1) to the number of lanes for through traffic on the opposite road, for example. The number of lanes for through traffic is acquired based on the road-shape information provided from the infrastructure facility.

As for the oncoming straight-ahead vehicle detected by the autonomous sensor mounted to the own vehicle waiting to turn right, when the oncoming right-turning vehicle waits to turn right, for example, a blind angle is formed in the detection region of the autonomous sensor by the oncoming right-turning vehicle. In this case, when the oncoming straight-ahead vehicle is present in the blind angle region, the number of the oncoming straight-ahead vehicles detected by the autonomous sensor is smaller than the number of the oncoming straight-ahead vehicles obtained from the infrastructure facility. Therefore, as the difference Δn increases, the vision of the driver is significantly hindered by the oncoming right-turning vehicle, which means that the degree of risk upon the right turn increases accordingly. When the number of the lanes for through traffic on the opposite road is large, and when the oncoming right-turning vehicle waits to turn right on the opposite right turn lane, the opposite lane for through traffic close to the right turn lane on the road is significantly hindered in the driver's vision, and the vision for the lanes for through traffic apart from the opposite right turn lane gradually increases. Therefore, since the threshold value is set based on the number of the lanes for through traffic on the opposite road, the degree of risk upon the right turn corresponding to the condition of the driver's vision can be determined.

When proceeding to step S30, the support processing section 14 determines that the driver's vision is very poor since the blind angle hindering the detection range of the autonomous sensor is large, and a deviation ratio of the number of the oncoming straight-ahead vehicles detected by the autonomous sensor to the number of the oncoming straight-ahead vehicles obtained by the infrastructure facility is large. Therefore, the support processing section 14 executes weighting to increase the evaluation rank set in the step S27 by 1 (evaluation rank←evaluation rank+1), and then, proceeds to step S33.

The support processing section 14 checks whether the difference Δn is 0 or not in step S29. When the difference Δn is 1 or larger (Δn>0), the support processing section 14 proceeds to step S31. When the difference Δn is 0 (Δn=0), the support processing section 14 proceeds to step S32.

When proceeding to step S31, the support processing section 14 determines that the driver's vision is poor since the blind angle hindering the detection range of the autonomous sensor is small, and the deviation ratio of the number of the oncoming straight-ahead vehicles detected by the autonomous sensor to the number of the oncoming straight-ahead vehicles obtained by the infrastructure facility is small, because the difference Δn is less than the threshold value, but not 0. Therefore, the support processing section 14 does not change the evaluation rank without executing the weighting, and then, proceeds to step S33.

When the support processing section 14 proceeds to step S32, it determines that the driver can visually recognize all oncoming straight-ahead vehicles (the vision is satisfactory), since the difference Δn is 0, and a vehicle waiting to turn right (oncoming right-turning vehicle) is not present. Therefore, the support processing section 14 clears the evaluation rank (evaluation rank←0), and then, proceeds to step S33. Table 6 illustrates the processes in the above-mentioned steps S28 to S32 as a list.

TABLE 6

| | Weighting process to evaluation rank | |
|---|---|---|
| Δn ≧ threshold value | 1 rank up | Vision is very poor → increase degree of risk |
| Threshold value > Δn | Unchanged | Vision is poor → maintain determination result |
| Δn = 0 | 0 | Vision is satisfactory → no support |

When proceeding to step S33, the support processing section 14 sets right-turn driving support information according to the weighted evaluation rank, and exits the routine. The processes in the steps S27 to S33 correspond to the right-turn support information setting unit in the present invention.

Table 7 illustrates the right-turn driving support information.

TABLE 7

| Evaluation rank | Degree of risk | Output of sound (Sound outputted from speaker) | Warning message (speech output) | Color (indicator, LCD, etc.) | Lighting cycle |
|---|---|---|---|---|---|
| 0 | None | No sound | No message | No color | No cycle |
| 1-2 | Low | Beep | There is oncoming vehicle | Yellow | Slow (e.g., 0.5 Hz) |
| 3-5 | Middle | Beep, beep | Beware of oncoming vehicle | Yellow | Fast (e.g., 0.3 Hz) |
| 6-10 | High | Beep, beep, beep | Beware of oncoming vehicle | Red | Fast (e.g., 0.3 Hz) |

The degree of risk in the right-turn driving support information according to the present embodiment is classified into 4 levels according to the evaluation rank. The right-turn driving support information is informed by an auditory informing unit such as a buzzer sound or a speech and a visual unit with the use of a lamp such as an indicator lamp, LCD (Liquid Crystal Display) lamp. The right-turn driving support information may be reported to the driver by text displayed on an LCD monitor.

Specifically, in Table 7, when the evaluation rank is 1 or 2, which means the degree of risk is "low," firstly a buzzer is beeped once, and then, a message of "an oncoming vehicle is coming" is reported as a speech, as well as the display lamp provided on an instrument panel is flickered in yellow at a relatively long cycle (e.g., 0.5 [Hz])]. When the evaluation rank is 3 to 5, which means the degree of risk is "middle," firstly the buzzer is beeped twice, and then, the message of "beware of oncoming vehicle" is reported as a speech as well as the display lamp is flickered in yellow at a relatively short cycle (e.g., 0.3 [Hz]). When the evaluation rank is 6 to 10, which means the degree of risk is "high," firstly the buzzer is beeped three times, and then, the message of "beware of oncoming vehicle" is reported as a speech as well as the display lamp is flickered in red at a relatively short cycle (e.g., 0.3 [Hz}).

As described above, in the present embodiment, the oncoming right-turning vehicle rank flag corresponding to the type (size of the vehicle body) of the oncoming right-turning vehicle is set, and the evaluation rank is set to be one of 10 levels that are 0 to 9 based on the oncoming right-turning vehicle rank flag and the oncoming straight-ahead vehicle rank flag. Therefore, more accurate right-turn driving support information can be acquired when the own vehicle waits to turn right at the traffic intersection.

Figure 5:
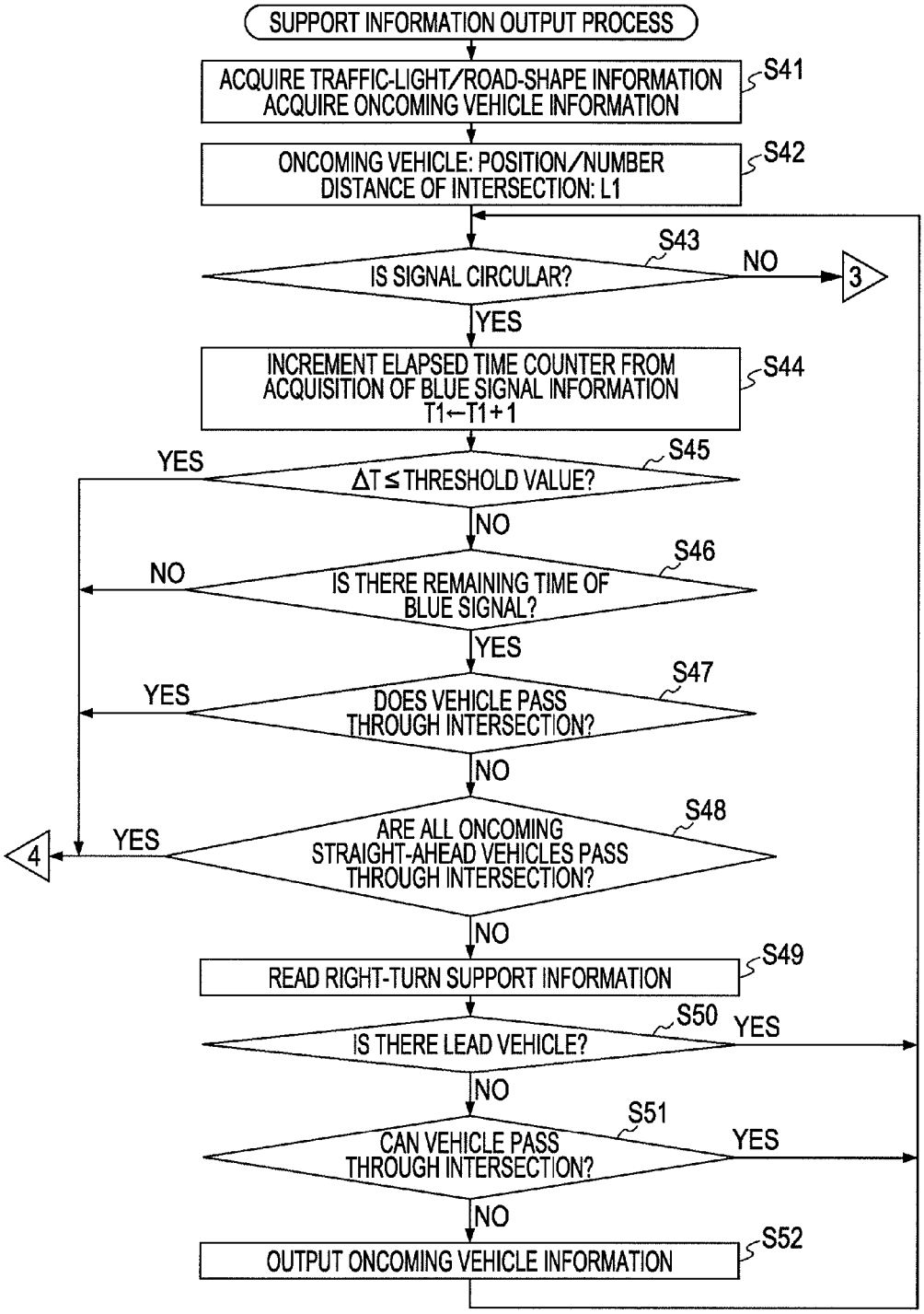
FIG. 5 is a flowchart (1) illustrating a support information output process routine.
Figure 6:
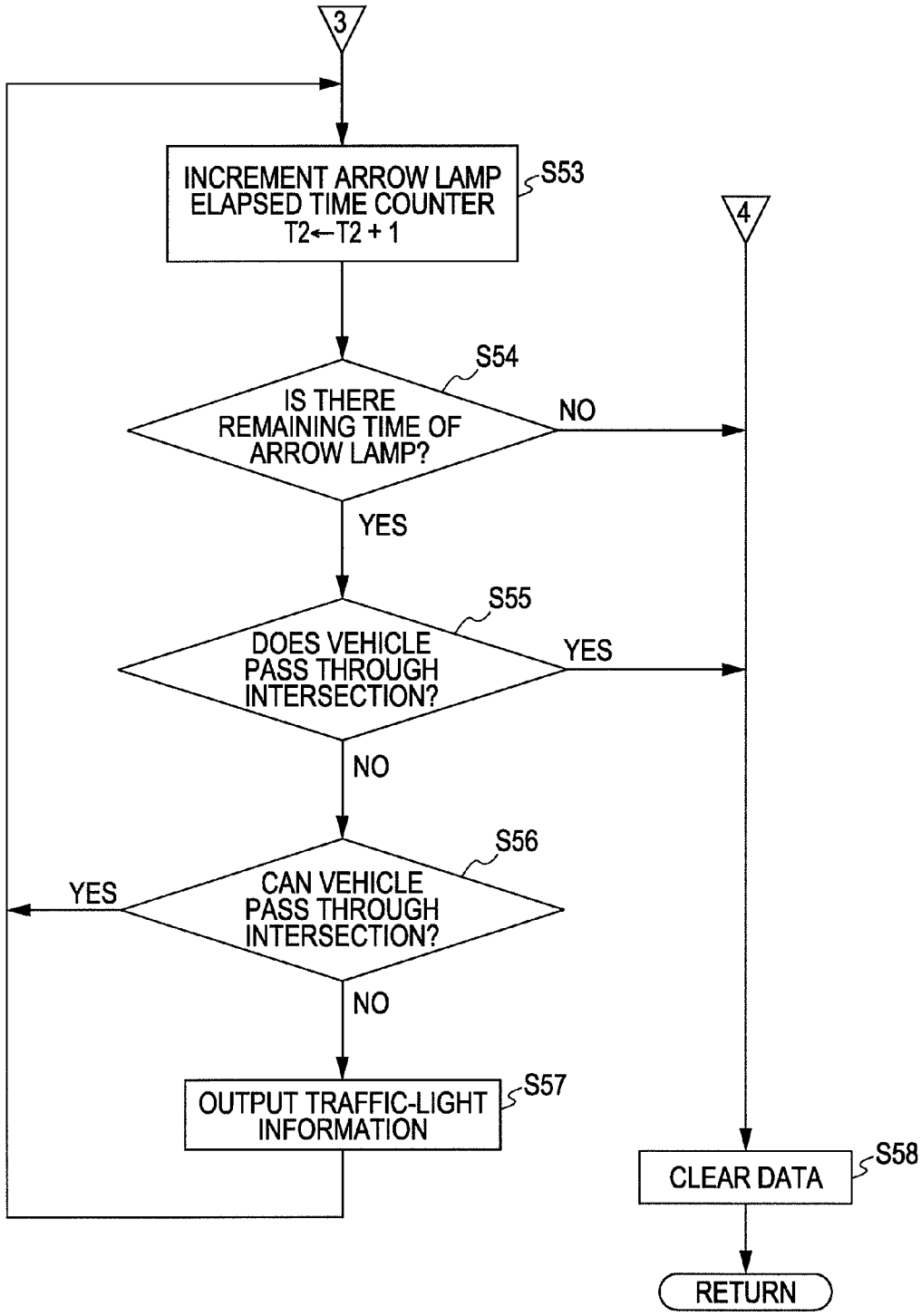
FIG. 6 is a flowchart (2) illustrating a support information output process routine.

Whether the right-turn driving support information set in the step S33 has to be given to the driver or not is determined in a support information output process routine illustrated in FIGS. 5 and 6.

In this routine, the support processing section 14 acquires the traffic-light information, the road-shape information, and the oncoming vehicle information from the infrastructure facility in step S41. In step S42, the support processing section 14 reads the number of oncoming straight-ahead vehicles, and the position of each of the oncoming straight-ahead vehicles based on the acquired oncoming vehicle information, and acquires a distance (length) L1 from a stop position where the own vehicle waits to turn right to a position where the own vehicle completely crosses the traffic intersection based on the acquired road-shape information.

Then, the support processing section 14 proceeds to step S43 so as to determine the shape of the signal lamp lighting in blue based on the acquired the traffic-light information. When the shape of the traffic lamp is circular, the support processing section 14 proceeds to step S44, and when a right-turn arrow lamp is lighted, it jumps to step S53. Whether the traffic light is provided with the right-turn arrow lamp or not is acquired from the traffic-light information provided from the infrastructure f.

When proceeding to step S44, the support processing section 14 determines a condition for performing right-turn driving support in steps S44 to S48.

In step S44, when the signal lamp is blue, the support processing section 14 counts an elapsed time T1 from the time when the information is acquired. When the infrastructure facility mounted in front of the traffic light is an optical beacon, the traffic-light information is acquired only when the own vehicle passes through the infrastructure facility. After the own vehicle passes through the infrastructure facility, it is necessary to count the elapsed time T1 to obtain a changeover timing of the color of the signal lamp.

Thereafter, the support processing section 14 proceeds to step S45 to obtain a distance to the traffic intersection obtained from the road-shape information and the time taken for the vehicle to reach the target traffic intersection from a current vehicle speed. Then, the support processing section 14 compares a difference ΔT between the obtained arrival time to the target traffic intersection and the acquired remaining time of the blue light and a threshold value. When the difference ΔT exceeds the threshold value (ΔT>threshold value), the support processing section 14 proceeds to step S46. When the difference ΔT is equal to or less than the threshold value (ΔT≦threshold value), the support processing section 14 determines that driving support is unnecessary, so that it jumps to step S58. As an example of the threshold value, the time from when the information is provided to the time when the driver reacts may be varied to a safety side based on the road surface condition, and estimated result of μ on a road.

A situation in which the support processing section 14 proceeds to step S46 is such that the own vehicle travels toward the target traffic intersection. Whether the right turn is possible or not is determined from the relationship between the current remaining time of the blue light and the position of the own vehicle. Specifically, it is determined based on an integrated time counted after the data is acquired from the infrastructure installation, an integrated distance, and the own vehicle speed. When the remaining time of the blue light is longer than the time taken for the own vehicle to enter the traffic intersection, the support processing section 14 proceeds to step S47, and when it is shorter, the support processing section 14 jumps to step S58.

In step S47, the support processing section 14 checks whether the own vehicle waiting to turn right passes through the traffic intersection or not, i.e., whether or not the driver determines that he/she can turn right and turns right. Whether the own vehicle waiting to turn right turns right or not can be determined by the change in an image, if a camera is mounted as the autonomous sensor, or by the movement of a coordinate point, if a car navigation system is mounted. Alternatively, it may be determined based on a steering angle and an acceleration speed.

When the support processing section 14 determines that the vehicle turns right (that the vehicle passes through the traffic intersection), it jumps to step S58, since it is unnecessary to execute driving support. When the vehicle still waits to turn right, the support processing section 14 proceeds to step S48.

In step S48, the support processing section 14 determines whether all of the oncoming straight-ahead vehicles pass through the traffic intersection or not by the comparison between a count value (passing count value) of the passing oncoming straight-ahead vehicles and the number of the oncoming straight-ahead vehicles acquired from the infrastructure facility. When the passing count value does not reach the number of the oncoming straight-ahead vehicles, the support processing section 14 determines that the oncoming straight-ahead vehicles corresponding to the number of the oncoming straight-ahead vehicles detected by the infrastructure facility have not yet passed, so that it proceeds to step S49. On the other hand, when the passing count value reaches the number of the oncoming straight-ahead vehicles acquired from the infrastructure facility, there is no effectiveness of data, so that the support processing section 14 jumps to step S58.

When the support processing section 14 satisfies all conditions in the above-mentioned steps S45 to S48, and proceeds to step S49, it reads the right-turn driving support information set in the above-mentioned right-turn driving support process routine, and then, proceeds to step S50. The process in this step corresponds to a right-turn lead vehicle determining unit in the present invention.

In step S50, the support processing section 14 checks whether there is a lead vehicle, which waits to turn right, based on the information detected by the autonomous sensor. When there is the lead vehicle, the support processing section 14 returns to step S43. When there is no lead vehicle, it proceeds to step S50.

When it is determined that there is a lead vehicle, the vehicle cannot turn right. Therefore, it is unnecessary to inform the driver of the right-turn driving support information. Accordingly, the support processing section 14 returns to step S43 without informing the driver of the right-turn driving support information, thereby being capable of reducing a troublesome feeling given to the driver.

On the other hand, when the support processing section 14 determines that there is no lead vehicle waiting to turn right, and hence the own vehicle is the lead vehicle, and proceeds to step S51, it checks whether or not the own vehicle can pass the traffic intersection within the remaining time of a blue signal based on the remaining time of the blue signal and the distance (length) L1 to the position where the own vehicle completely passes through the traffic intersection. The time required to complete the right turn is the time taken for the own vehicle to pass the distance L1 with a certain acceleration speed. Therefore, since the acceleration speed is obtained beforehand from an experiment and the like, the time can be calculated based on the distance L1.

When the support processing section 14 determines that the own vehicle can pass, it returns to step S43, since the own vehicle can safely turn right without executing the right-turn driving support at the current moment. On the other hand, the support processing section 14 determines that it is difficult to pass, it proceeds to step S52 so as to output the right-turn driving support information which is read in step S49, to the information providing apparatus 23, and then, returns to step S43. With this, the information providing apparatus 23 outputs the right-turn driving support information corresponding to the above-mentioned evaluation ranking (see Table 7), and informs the driver of this information.

On the other hand, when the support processing section 14 branches to step S53 from step S43, it increments an arrow signal elapsed time counter T2 that counts a lighting time of the right turn arrow lamp, (T2←T2+1), and checks in step S54 the remaining time of the right turn arrow lamp from a difference between the lighting time of the right turn arrow lamp included in the traffic-light information provided from the infrastructure facility and the elapsed time counter T2. When the support processing section 14 determines that there is a remaining time, it proceeds to step S55. When it determines that there is no remaining time, it jumps to step S28, since the vehicle is brought into a state of waiting to turn right until the blue signal lamp is again lighted, and hence, there is no more effectiveness of the data.

When the support processing section 14 proceeds to step S55, it checks whether the own vehicle waiting to turn right passes through the traffic intersection or not. When the vehicle turns right, the driving support is unnecessary, so that the support processing section 14 jumps to step S58. When the vehicle still waits to turn right, it proceeds to step S56. In step S56, the support processing section 14 determines whether or not the own vehicle can pass the traffic intersection within the remaining time of the right turn arrow lamp based on the remaining time of the right turn arrow lamp and the distance L1 to a position where the vehicle completely crosses the traffic intersection. When it determines that the vehicle can pass the traffic intersection, the support processing section 14 returns to step S53, since there is no need to execute right-turn driving support at the current moment. On the other hand, when it determines that it is difficult to pass the traffic intersection, the support processing section 14 proceeds to step S57 where it outputs the right-turn driving support information read in step S49 to the information providing apparatus 23, and then, returns to step S53.

When the support processing section 14 proceeds to step S58 from any one of steps S45 to S48, S54 and S55, it clears the data acquired this time and the calculated data, and then, exits the routine.

As described above, in the present embodiment, in case where the own vehicle is not a lead vehicle, or in case where a right turn is apparently possible, when the right-turn driving support information according to the above-mentioned evaluation rank is given to the driver of the own vehicle waiting to turn right, the right-turn driving support information is not given to the driver. Accordingly, a troublesome feeling given to the driver upon the right turn can be reduced.

The present invention is not limited to the above-mentioned embodiment. For example, the blind angle rank may be classified into 4 or more types.

What is claimed is:

1. A driving support apparatus comprising:

an information informing unit that informs a driver of support information;

an oncoming vehicle information analyzing unit that analyzes information of an oncoming vehicle acquired from an exterior information transmitting source;

an oncoming vehicle data processing unit that checks the position and type of the oncoming vehicle from the oncoming vehicle information analyzed by the oncoming vehicle information analyzing unit; and a support processing unit that sets the support information, which is to be given to an own vehicle waiting to turn across an opposite road on which the oncoming vehicle runs, and outputs the support information to the information informing unit, based on the type and the position of one or more oncoming vehicles checked by the oncoming vehicle data processing unit, wherein the support processing unit includes a blind angle rank setting unit that sets a blind angle rank according to a degree to which a following vehicle enters the blind angle of a leading oncoming vehicle, based on the relationship in the type between the leading oncoming vehicle and the following vehicle among oncoming vehicles traveling straight on the opposite road, and a support information setting unit that sets the support information based on the blind angle rank set by the blind angle rank setting unit.

2. The driving support apparatus according to claim 1, wherein the support processing unit includes an oncoming straight-ahead vehicle rank flag setting unit that selects the highest blind angle rank among the blind angle ranks between the oncoming vehicles set by the blind angle rank setting unit so as to set an oncoming straight-ahead vehicle rank flag, wherein the support information setting unit sets the support information based on the oncoming straight-ahead vehicle rank flag.

3. The driving support apparatus according to claim 2, wherein the support processing unit includes an oncoming turning vehicle determining unit that determines a type of an oncoming turning vehicle that waits to turn across a road on which the own vehicle runs, based on information acquired from the exterior information transmitting source or an autonomous sensor mounted to the own vehicle, and an oncoming turning vehicle rank flag setting unit that sets an oncoming turning vehicle rank flag corresponding to a size of the blind angle formed by the oncoming turning vehicle, based on the type of the oncoming turning vehicle determined by the oncoming turning vehicle determining unit, and wherein the support information setting unit sets an evaluation rank, which indicates a degree of risk when the own vehicle turns across the opposite road, based on the oncoming straight-ahead vehicle rank flag and the oncoming turning vehicle rank flag, and sets the support information based on the evaluation rank.

4. The driving support apparatus according to claim 3, wherein the support information setting unit calculates a difference between the number of the oncoming straight-ahead vehicles traveling on an opposite lane for through traffic of the opposite road, stored by the oncoming vehicle data processing unit, and the number of the oncoming straight-ahead vehicles passing through a traffic intersection, acquired by the autonomous sensor, and performs a weighting to the evaluation rank based on the difference.

5. The driving support apparatus according to claim 1, wherein the support processing unit includes a lead vehicle determining unit that checks whether or not an in-lane lead vehicle waiting to turn across the opposite road is present in front of the own vehicle based on information acquired by an autonomous sensor mounted to the own vehicle, and does not inform the driver of the support information when an in-lane lead vehicle is present.

6. The driving support apparatus according to claim 2, wherein the support processing unit includes a lead vehicle determining unit that checks whether or not an in-lane lead vehicle waiting to turn across the opposite road is present in front of the own vehicle based on information acquired by an autonomous sensor mounted to the own vehicle, and does not inform the driver of the support information when an in-lane lead vehicle is present.

7. The driving support apparatus according to claim 3, wherein the support processing unit includes a lead vehicle determining unit that checks whether or not an in-lane lead vehicle waiting to turn across the opposite road is present in front of the own vehicle based on information acquired by the autonomous sensor mounted to the own vehicle, and does not inform the driver of the support information when an in-lane lead vehicle is present.

8. The driving support apparatus according to claim 4, wherein the support processing unit includes a lead vehicle determining unit that checks whether or not an in-lane lead vehicle waiting to turn across the opposite road is present in front of the own vehicle based on information acquired by the autonomous sensor mounted to the own vehicle, and does not inform the driver of the support information when an in-lane lead vehicle is present.

9. The driving support apparatus according to claim 1, wherein the support processing unit sets support information based, in part, on environmental information acquired from either an exterior information transmitting source or an autonomous sensor mounted to the own vehicle.

10. The driving support apparatus according to claim 9, wherein the support processing unit sets support information based, in part, on environmental information that includes at least one of: traffic-light information; stop-line information; and road-shape information.

11. The driving support apparatus according to claim 9, wherein the support processing unit sets support information based, in part, on environmental information that includes traffic-light information informing of the remaining time before a traffic signal will change.

12. The driving support apparatus according to claim 9, wherein the support processing unit sets support information based, in part, on environmental information that includes road-shape information of the opposite road on which the oncoming vehicles are travelling.

13. The driving support apparatus according to claim 1, wherein the support processing unit sets support information based, in part, on the information of an oncoming vehicle that includes at least one of: the oncoming vehicle's speed; the oncoming vehicle's distance; and the oncoming vehicle's course information.

14. The driving support apparatus according to claim 13, wherein the support processing unit sets support information based, in part, on the information of an oncoming vehicle that includes the oncoming vehicle's course information informing of the lane in which the oncoming vehicle is travelling.

15. The driving support apparatus according to claim 14, wherein the support processing unit sets support information based, in part, on the information of an oncoming vehicle that includes the oncoming vehicle's course information informing whether the oncoming vehicle is travelling in a lane for through traffic or travelling in a lane for turning traffic.

16. The driving support apparatus according to claim 1, wherein the support processing unit includes a turn-monitoring unit that determines if the own vehicle has passed through an intersection, and the support processing unit does not output the support information to the information informing unit when the turn-monitoring unit determines that the own vehicle has passed through the intersection.

17. The driving support apparatus according to claim 1, further comprising an autonomous sensor mounted to the own vehicle that detects oncoming vehicles, wherein the support processing unit sets support information based, in part, on information of oncoming traffic acquired from an exterior information transmitting source that includes a count of oncoming vehicles, the support processing unit generates a count of the oncoming vehicles detected by the autonomous sensor which are determined to pass through an intersection at which the own vehicle is waiting to turn, the support processing unit compares the count of oncoming vehicles obtained from the information of oncoming traffic acquired from the exterior information transmitting source, with the count of oncoming vehicles detected by the autonomous sensor and determined to pass through the intersection, and the support processing unit does not output the support information to the information informing unit when the count of oncoming vehicles detected by the autonomous sensor and determined to pass through the intersection reaches the count of oncoming vehicles obtained from the information of oncoming traffic acquired from the exterior information transmitting source.

18. The driving support apparatus according to claim 1, wherein the support processing unit sets support information based, in part, on environmental information acquired from either an exterior information transmitting source or an autonomous sensor mounted to the own vehicle, the environmental information includes intersection information informing of a distance from the own vehicle to an intersection, and traffic-light information informing of the remaining time before a traffic signal at the intersection will change, the support processing unit calculates a projected time for the own vehicle to reach the intersection based on the distance to the intersection and the speed of the own vehicle, and calculates a difference between the projected time for the own vehicle to reach the intersection and the remaining time before the traffic signal at the intersection will change, and the support processing unit does not output the support information to the information informing unit when the calculated difference between the projected time for the own vehicle to reach the intersection and the remaining time before the traffic signal at the intersection will change is determined to be less than a threshold value.

19. The driving support apparatus according to claim 1, further comprising an autonomous sensor mounted to the own vehicle that detects oncoming vehicles, wherein the support processing unit sets support information based, in part, on information of oncoming traffic acquired from an exterior information transmitting source that includes a count of oncoming vehicles, the support processing unit generates a count of the oncoming vehicles detected by the autonomous sensor, the support processing unit compares the count of oncoming vehicles obtained from the information of oncoming traffic acquired from the exterior information transmitting source, with the count of oncoming vehicles detected by the autonomous sensor, and the support processing unit does not output the support information to the information informing unit when the count of oncoming vehicles detected by the autonomous sensor equals the count of oncoming vehicles obtained from the information of oncoming traffic acquired from the exterior information transmitting source.

* * * * *